US010978811B2

(12) United States Patent
Saeidi et al.

(10) Patent No.: US 10,978,811 B2
(45) Date of Patent: Apr. 13, 2021

(54) SLOT ANTENNA ARRAYS FOR MILLIMETER-WAVE COMMUNICATION SYSTEMS

(71) Applicant: Motorola Mobility LLC, Chicago, IL (US)

(72) Inventors: Chiya Saeidi, Chicago, IL (US); Eric Le Roy Krenz, Crystal Lake, IL (US)

(73) Assignee: Motorola Mobility LLC, Chicago, IL (US)

( * ) Notice: Subject to any disclaimer, the term of this patent is extended or adjusted under 35 U.S.C. 154(b) by 290 days.

(21) Appl. No.: 16/173,981

(22) Filed: Oct. 29, 2018

(65) Prior Publication Data

US 2020/0136268 A1 Apr. 30, 2020

(51) Int. Cl.

| | |
|---|---|
| ***H01Q 1/24*** | (2006.01) |
| ***H01Q 21/06*** | (2006.01) |
| ***H01Q 13/12*** | (2006.01) |
| ***H01Q 13/18*** | (2006.01) |

(52) U.S. Cl.
CPC ..... *H01Q 21/064* (2013.01); *H01Q 13/12* (2013.01); *H01Q 13/18* (2013.01)

(58) Field of Classification Search
CPC ..... H01Q 13/10–13/12; H01Q 13/18; H01Q 21/064; H01Q 1/22–1/24
See application file for complete search history.

(56) References Cited

U.S. PATENT DOCUMENTS

| | | | | |
|---|---|---|---|---|
| 5,107,232 | A | 4/1992 | Evans | |
| 10,608,321 | B2 * | 3/2020 | Jiang | H01Q 9/0421 |
| 2005/0146475 | A1 * | 7/2005 | Bettner | H01Q 1/2266 343/767 |
| 2013/0278468 | A1 * | 10/2013 | Yehezkely | H01Q 1/2283 343/702 |
| 2017/0110787 | A1 | 4/2017 | Ouyang et al. | |

OTHER PUBLICATIONS

Helander,"Performance Analysis of Millimeter-Wave Phased Array Antennas in Cellular Handsets", Jul. 2015, pp. 504-507.
Stanley,"A High Gain Steerable Millimeter-Wave Antenna Array for 5G Smartphone Applications", Mar. 2017, 5 pages.

(Continued)

*Primary Examiner* — Hasan Z Islam
(74) *Attorney, Agent, or Firm* — FIG. 1 Patents

(57) ABSTRACT

Techniques described herein provide slot antenna arrays for a millimeter-wave communication system. One or more implementations form a slot antenna array by creating multiple slot antenna out of a metal band that surrounds an outer edge of a housing structure. Various implementations form the slot antenna array to support millimeter waveforms associated with the millimeter-wave communication system. To form the antenna array, one or more implementations capacitively couple a respective signal feed to each respective slot antenna using a stripline connected to an inner edge of the metal band, where the stripline provides isolation between the antenna array and hardware components included in the housing structure. In response to coupling the signal feeds to the slot antenna, various implementations transmit a beam-formed wireless signal associated with the millimeter-wave communication system to enable successful data exchanges.

19 Claims, 7 Drawing Sheets

(56) References Cited

OTHER PUBLICATIONS

Wong,"GPS/WLAN open-slot antenna with a sticker-like substrate for the metal-casing smartphone", Aug. 30, 2015, 7 pages.
Yu,"A Novel 28 GHz Beam Steering Array for 5G Mobile Device With Metallic Casing Application", Jan. 2018, pp. 462-466.
Zhang,"A Planar Switchable 3-D-Coverage Phased Array Antenna and Its User Effects for 28-GHz Mobile Terminal Applications", Dec. 2017, pp. 6413-6421.
"Extended European Search Report", EP Application No. 19205239.7, dated Mar. 2, 2020, 12 pages.
Robertson,"The Design of Transverse Slot Arrays Fed by the Meandering Strip of a Boxed Stripline", Mar. 1987, pp. 252-257.
Sommers,"Slot Array Employing Photoetched Tri-Plate Transmission Lines", Mar. 1995, pp. 157-162.

* cited by examiner

SLOT ANTENNA ARRAYS FOR MILLIMETER-WAVE COMMUNICATION SYSTEMS

BACKGROUND

The evolution of wireless communications puts increased demands on the devices that implement wireless functionality. For example, increased transmission frequencies translate into smaller wavelengths. In turn, these smaller wavelengths pose challenges to the electronic circuitry associated with the transceiver paths, such as size, accuracy, interference, shielding, etc. To further compound these challenges, devices that support wireless communications oftentimes have constrained space in which to incorporate the supporting hardware, thus imposing additional restrictions on how the devices can support these features.

BRIEF DESCRIPTION OF THE SEVERAL VIEWS OF THE DRAWINGS

While the appended claims set forth the features of the present techniques with particularity, these techniques, together with their objects and advantages, may be best understood from the following detailed description taken in conjunction with the accompanying drawings of which:

DETAILED DESCRIPTION

Figure 1:
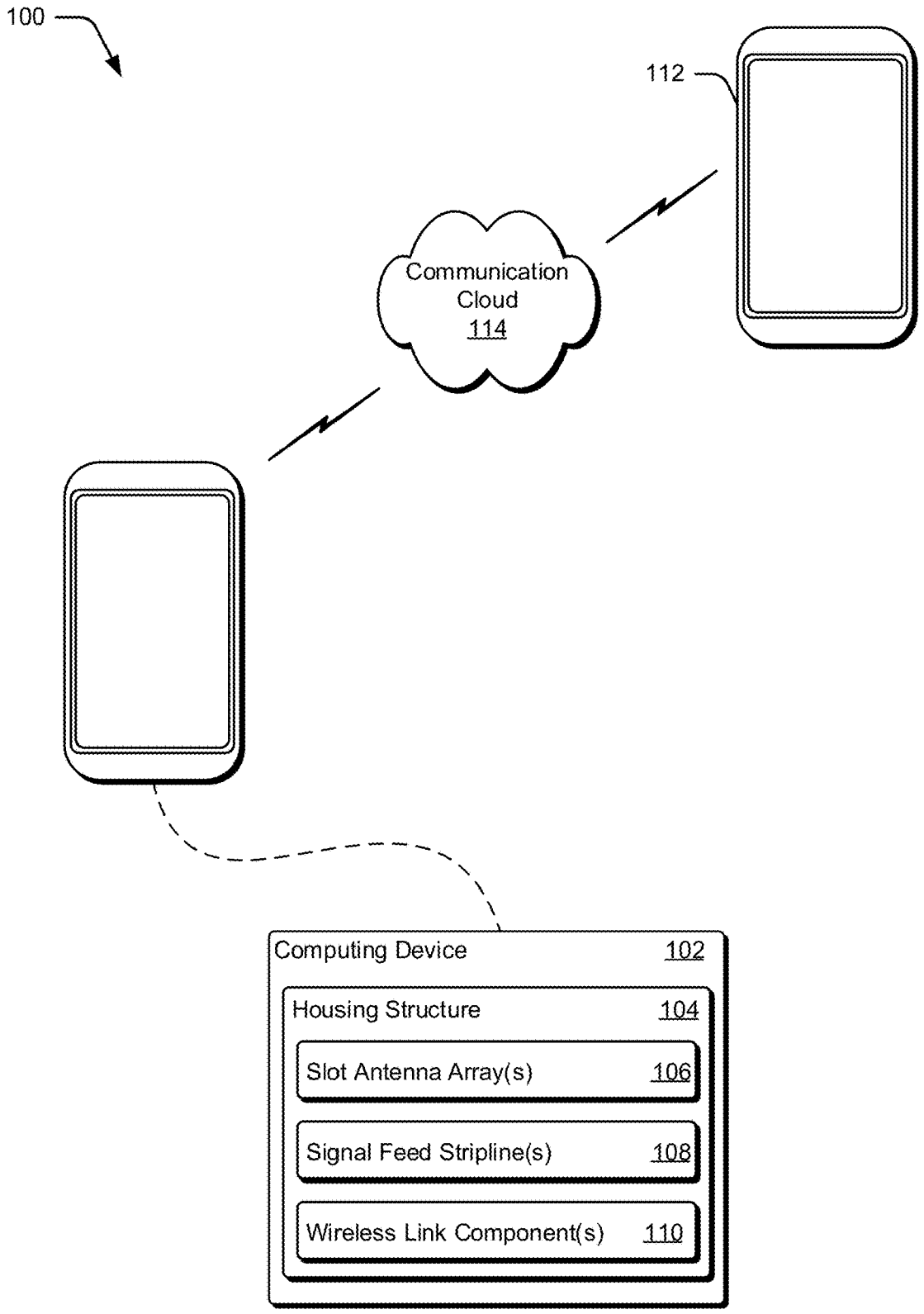
FIG. 1 is an overview of a representative environment in which slot antenna arrays can be employed in accordance with one or more implementations.

Turning to the drawings, wherein like reference numerals refer to like elements, techniques of the present disclosure are illustrated as being implemented in a suitable environment. The following description is based on embodiments of the claims and should not be taken as limiting the claims with regard to alternative embodiments that are not explicitly described herein.

Techniques described herein provide slot antenna arrays for millimeter-wave communication system transmissions. One or more implementations form a slot antenna array by creating multiple slot antenna out of a metal band that surrounds an outer edge of a housing structure. Various implementations form the slot antenna array to support millimeter waveforms associated with a millimeter-wave communication system. To form the antenna array, one or more implementations electronically and/or capacitively couple a respective signal feed to each respective slot antenna using a stripline connected to an inner edge of the metal band. In such a scenario, the feed line is not exposed and is backed up by a conductor, hence the stripline provides isolation between the antenna array and hardware components included in the housing structure while directing the antenna power outwards. In response to coupling the signal feeds to the slot antenna, various implementations transmit a beam-formed wireless signal associated with the millimeter-wave communication system to enable successful data exchanges.

Consider now an example environment in which various aspects as described herein can be employed.

Example Environment

FIG. 1 illustrates an example environment 100 that includes an example computing device 102 in the form of a mobile phone. Here, computing device 102 includes wireless communication capabilities to facilitate a bi-directional link between various computing devices through various wireless networks, such as a wireless local area network (WLAN), a wireless telecommunication network, a wireless (Wi-Fi) access point, and so forth. Various implementations of computing device 102 include support for a $5^{th}$ Generation Wireless Systems (5G) communication system.

Computing device 102 includes housing structure 104 that generally represents a housing structure or chassis that encloses the various hardware, firmware, and/or software components that make up the computing device. Housing structure 104 can be made of any suitable type and combinations of material, such as a metal, a polymer, a composite, a ceramic, etc. Housing structure 104 generally includes slot antenna array(s) 106 that are used to radiate and receive electromagnetic waves used by computing device 102 to wirelessly communicate with other devices.

Slot antenna arrays 106 represent one or more arrays of multiple antenna, where each respective antenna is constructed from the material associated with housing structure 104. In other words, the physical construction of slot antenna arrays 106 uses part or all of housing structure 104. For instance, some implementations construct a slot antenna by cutting an aperture, hole, and/or slot out of the housing material, such as in a metal band that encases and/or forms the outer edges of the housing structure. The size, shape, and/or depth associated with each respective slot antenna can be chosen such that the corresponding antenna radiates and receives signals over a desired frequency range. As one example, some implementations configure the respective slot antennas of an array with dimensions that correspond to a portion or all of the frequency range generally associated with the millimeter wave spectrum, such as, by way of example and not of limitation, 24-86 Gigahertz (GHz). Here, the term "generally" is used to indicate a frequency range over which each respective slot antenna in slot antenna array 106 radiates and receives frequencies successfully enough to recover information contained within the frequencies. This can include real-world deviations from the identified frequency range that allow for alternate frequencies not exactly at these values that provide successful functionality. When arranged in an array, various implementations configure the multiple slot antenna to collectively radiate signals in a desired transmission pattern using knowledge of the constructive and/or destructive interference properties of the signals. Computing device 102 can include a single array of slot antenna, or multiple arrays of slot antenna, where each array resides at a different location.

Various implementations drive slot antenna array(s) 106 using stripline(s) 108. Generally, the stripline overlays on a respective array of slot antenna to provide each respective slot antenna with an independent signal feed. In turn, each feed can be independently modified such that the collective transmission using slot antenna array(s) 106 forms a desired radiation pattern, such as a beam-formed signal with a particular strength, size, shape, and/or direction. Various implementations form transmissions line(s) within striplines 108 by surrounding a strip of metal with parallel ground planes. The strip of metal is then separated from the ground planes using an insulation, such as a substrate. Various implementations alternately or additionally isolate the respective feeds within the stripline from one another by including notches, apertures, and/or vertical interconnection access (via) paths between the independent signal feeds as further described herein. To drive and/or excite the slot antenna arrays, various implementations electronically and/or capacitively couple the stripline to the antenna. For instance, some implementations place the signal feed within the stripline over the antenna apertures as further described herein.

Computing device 102 also includes wireless link component(s) 110 that generally represents any combination of hardware, firmware, and/or software components used to maintain a wireless link (e.g., protocol stacks, signal generation, signal routing, signal demodulation, signal modulation, etc.). For example, wireless link component(s) 110 can include any combination of protocol stacks, transceiver paths, modulators, demodulators, an analog-to-digital converter (ADC), a digital-to-analog converter (DAC), and so forth. Wireless link component(s) 110 can be partially or fully enclosed in housing structure 104. In combination, wireless link components 110, striplines 108, and/or slot antenna arrays 106 enable computing device 102 to communication with other devices wirelessly, such as with computing device 112 over communication cloud 114.

Communication cloud 114 generally represents any suitable type of communication network that facilitates a bi-directional link between various computing devices. This can include cell phone networks, WLANs, sensor networks, satellite communication networks terrestrial microwave networks, and so forth. Accordingly, communication cloud 114 can include multiple interconnected communication networks that comprise a plurality of interconnected elements, examples of which are provided herein. In this example, communication cloud 114 enables computing device 102 to communicate with computing device 112, where computing device 112 generally represents any type of device capable of facilitating wireless communications, such as a server, a desktop computing device, a base station, a cellular mobile phone, etc.

Having described an example operating environment in which various aspects of slot antenna arrays can be utilized, consider now a general discussion on signal radiation patterns in accordance with one or more implementations.

Signal Radiation Patterns

Computing devices today oftentimes include wireless capabilities to connect with other devices. To communicate information back and forth, the computing devices establish a wireless link between one another that conforms to predefined protocol and frequency standards. This conformity provides a mechanism for the devices to synchronize and exchange data via the wireless signals. A wireless link can be more powerful than a wired link in that it provides more freedom to the connecting devices. A device can connect wirelessly to any recipient device that supports a same wireless link format without using any additional peripheral components or devices. Not only does this allow the devices to exchange data, but it provides the additional benefit of mobility by eliminating a wired connection that physically tethers the communicating device.

Antennas are used to propagate and receive wireless signals. Being a form of electromagnetic radiation, the wireless signals propagated between the respective devices adhere to various wave and particle properties, such as reflection, refraction, scattering, absorption, polarization, etc. How antenna are designed and/or constructed can also influence what signal radiation pattern is propagated. To illustrate, consider a dipole antenna that includes two components symmetrical in length. In a half-wave dipole antenna, each pole has length of $$\frac{\lambda}{4},$$

where $\lambda$ represents a wavelength corresponding to a frequency at which the dipole antenna is resonant. When an antenna is resonant, waves of current and voltage traveling between the arms of the antenna create a standing wave. Thus, dipole antenna have longer poles for lower frequencies, and shorter poles for higher frequencies. An antenna also has its lowest impedance at its resonant frequency, thus simplifying impedance matching between the antenna and transmission lines for transmission or reception. In turn, this affects the power consumption and efficiency of an antenna. By careful adjustments to the antenna impedance, length, radius, and so forth, a designer can choose the frequency at which the corresponding antenna resonates. When transmitting, dipole antennas radiate with an omnidirectional pattern. However, other antenna configurations can be used to transmit omnidirectional patterns as well. One advantage to an omnidirectional radiation pattern is that it yields comprehensive coverage over a large area.

Figure 2A:
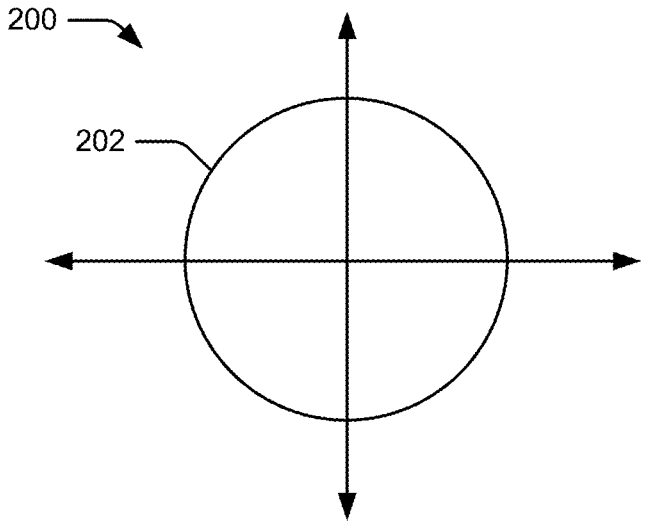
FIGS. 2A and 2B illustrate example signal propagations in accordance with one or more implementations.

Consider FIG. 2*a* that illustrates a two-dimensional graph 200 that plots an example omnidirectional radiation pattern 202. In various scenarios, the examples described with respect to FIGS. 2*a* and/or 2*b* can be considered a continuation of one or more examples described with respect to FIG. 1. Here, the omnidirectional radiation pattern forms a circle of coverage, where the corresponding antenna radiates an equal amount of energy in all directions. However, real-world implementations can deviate from this due to physical variations in the implementations. Among other things, radiation pattern 202 radiates outwardly from its source (e.g., the center of graph 200), where its signal strength tapers off as the signal moves away from its source. In other words, the center of graph 200 corresponds to an antenna source of transmission.

In terms of connecting with other devices, an omnidirectional radiation pattern allows the transmitting device to transmit without having any information on the location of a connecting device, since energy is transmitted equally in all directions. Thus, radiation pattern 202 allows the wireless networking device to transmit in all directions and service various user devices without needing any a priori knowledge of where the user devices are physically located. However, a downside to this approach is that since the antenna transmits energy in all directions, it also receives energy in all directions, thus reducing the signal-to-noise ratio (SNR), which, in turn, can make the communications more prone to errors. This can become particularly problematic in higher frequency bands where signals have shorter wavelengths, thus making the signals more susceptible to errors. An alternative to an omnidirectional transmission pattern is the transmission of a directional signal using beamforming techniques.

Beamforming combines transmissions from multiple antenna to create emission patterns using constructive or destructive interference. As one example, beamforming devices can use phased array antennas that work together to exploit these properties. By influencing the frequency, phase, and/or amplitude of each signal transmitted from a respective antenna, a transmitting device can generate a signal with a selective spatial pattern and/or direction. For example, two signals that are identical in frequency and amplitude are said to be in-phase if their oscillations are separated by 0° or 360°. Signals that are in phase exhibit constructive interference when they collide, which results in a single wave with an amplitude greater than either of the individual waves. Conversely, two signals that are identical in frequency and amplitude are said to be out-of-phase if their oscillations are separated by 180°. Signals that are out of phase exhibit destructive interference when they collide, thus cancelling each other out and resulting in no signal. Signals that vary from being perfectly in-phase or out-of-phase from one another result in partial construction or destruction, depending upon the phase differences. Phased array antennas work together to exploit these properties and generate a higher-gain or directional signal to a particular target. Thus, by adjusting the respective phase of each respective antenna in a phased array, various implementations can transmit signals in a desired direction. As one skilled in the art will appreciated, these examples of generating a desired signal radiation pattern using constructive and destructive interference via phase alterations has been simplified for discussion purposes.

Figure 2B:
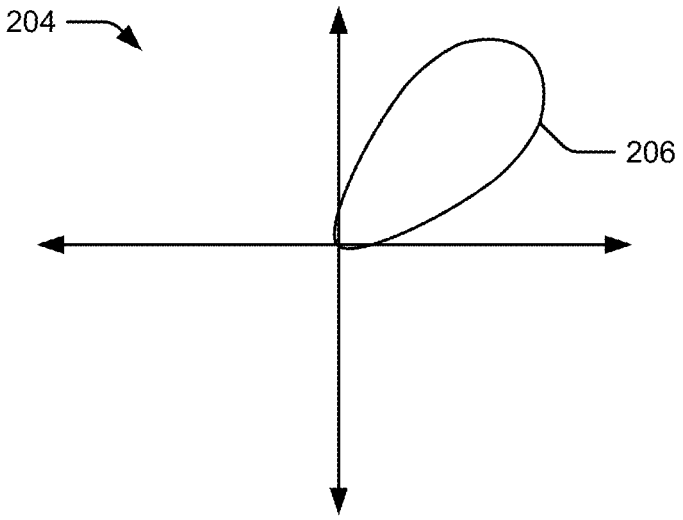

To demonstrate a targeted signal radiation pattern, consider FIG. 2*b* which illustrates a two-dimensional graph 204 that plots the main lobe of beam-formed radiation pattern 206. As in the case of radiation pattern 202, real-word implementations of radiation pattern 206 can vary due to physical variations in a corresponding implementation.

Beamforming focuses energy towards a particular direction, which, in turn, increases the power of the corresponding signal since the signal is not dispersed as in the omnidirectional case. This can improve the corresponding SNR and allow the transmitting device to improve data rates (e.g., transmit more data further) and extend how far the transmitted signal can travel. This can also reduce the amount of noise or interference the transmitting device contributes to other devices, especially in a noisy environment. By transmitting beam-formed directional signals, a computing device can reduce the amount of interference and/or RF noise it introduces into other devices operating in an adjacent region. Thus, beam-formed wireless signals provide reduced RF noise, relative to omnidirectional wireless signals. However, to gain coverage similar to an omnidirectional radiation pattern, some implementations utilize multiple antenna arrays, where each array transmits a radiation pattern in particular direction (e.g., a first array directed towards the first quadrant of graph 204, a second array directed toward the second quadrant of graph 204, a third array directed towards the third quadrant of graph 204, etc.). In turn, these multiple antenna arrays consume more space relative to a single antenna.

High frequency communication systems, such as a 5G communication system, benefit from the use of antenna arrays. For instance, some 5G communication systems use additional spectrum that are considered high frequencies relative to other communication systems, such as a spectrum band corresponding to millimeter wave lengths (e.g., 24-86 GHz). These high frequency rates, which also correspond to shorter wavelengths, pose several challenges to devices desiring to support a 5G communication system since these high frequency waveforms are prone to more free-space loss, atmospheric absorption, shorter transmission range for a given power, and scattering relative to lower frequencies.

While millimeter waveforms are more prone to degradation in a transmission mediums, millimeter waveforms at the higher frequencies advantageously have a smaller antenna length relative to lower frequencies. For instance, referring to a dipole antenna, since each pole has length of $$\frac{\lambda}{4}$$

for a resonant frequency corresponding to λ, a smaller wavelength corresponds to a smaller antenna size. In turn, a smaller antenna sizes make incorporating the corresponding antenna into a computing device more feasible, especially in scenarios in which space is limited. While described with respect to a dipole antenna, other antenna generally demonstrate the same property of size relative to waveform length. Since millimeter waveform antennas have a smaller size relative to antennas associated with lower frequencies, various implementations combat the transmission challenges associated with communication systems that utilize millimeter waveforms, such as challenges associated with free space loss, scattering, short transmission range, etc., through the use of an antenna array. By using antenna arrays, and corresponding beam-formed signals, the various devices can combat some of the signal-loss challenges posed by these higher frequencies. However, a tradeoff exists in balancing the inclusion of antenna array in a device with the corresponding space available.

Having described differences between various radiation patterns, consider now a discussion of slot antenna arrays in accordance with one or more embodiments.

Slot Antenna Arrays

More and more devices include wireless communication capabilities, thus putting a strain on the existing wireless communication systems. For example, as more devices share a same frequency band, the shared frequency band can become oversaturated. To remedy this strain, various communication systems, such as 5G communication systems, are expanding into higher frequency spectrums. These higher frequency bands not only pose challenges to successful signal transmission and reception, but they can adversely affect hardware as well, such as by making the electronics less energy efficient, putting a high demand on signal processing capabilities, introducing more phase noise, and so forth. When a computing device has a fixed size in which to incorporate the various types of hardware, this can cause a competition for space between the components. Accordingly, a tradeoff exists between including new functionality and the corresponding space utilized to implement that functionality.

To illustrate, consider a computing device that includes various types of electronics using a printed circuit board (PCB). Without proper isolation from the circuitry include in the PCB, RF signal feeds can incur degradation to a point where the signal no longer functions successfully. Therefore, the positioning of an antenna array and/or RF signal feeds relative to a PCB can include a setback or clearance to maintain a predetermined level of isolation, where the setback and/or clearance is void of electronics. As one example, coaxial cable can be utilized to deliver the independent signal feeds to each respective antenna of an antenna array with the inclusion of a setback. However, the frequency of the RF feed can drive the use of larger setbacks relative to frequencies in maintain a signal with the same quality. In other words, higher frequency rates increase the size of a setback relative to other frequencies in order to maintain a working signal. In turn, these setbacks consume more space and leave less space for other electronics.

Techniques described herein provide slot antenna arrays for millimeter waveform transmissions associated with millimeter-wave communication systems. One or more implementations form a slot antenna array by creating multiple slot antenna out of a metal band that surrounds an outer edge of a housing structure. Various implementations form the slot antenna array to support millimeter-wave communication systems. To form the antenna array, one or more implementations electronically and/or capacitively couple a respective signal feed to each respective slot antenna using a stripline connected to an inner edge of the metal band, where the stripline provides isolation between the antenna array and hardware components included in the housing structure. In response to coupling the signal feeds to the slot antenna, various implementations transmit a beam-formed wireless signal associated with the millimeter-wave communication system to enable successful data exchanges.

Figure 3:
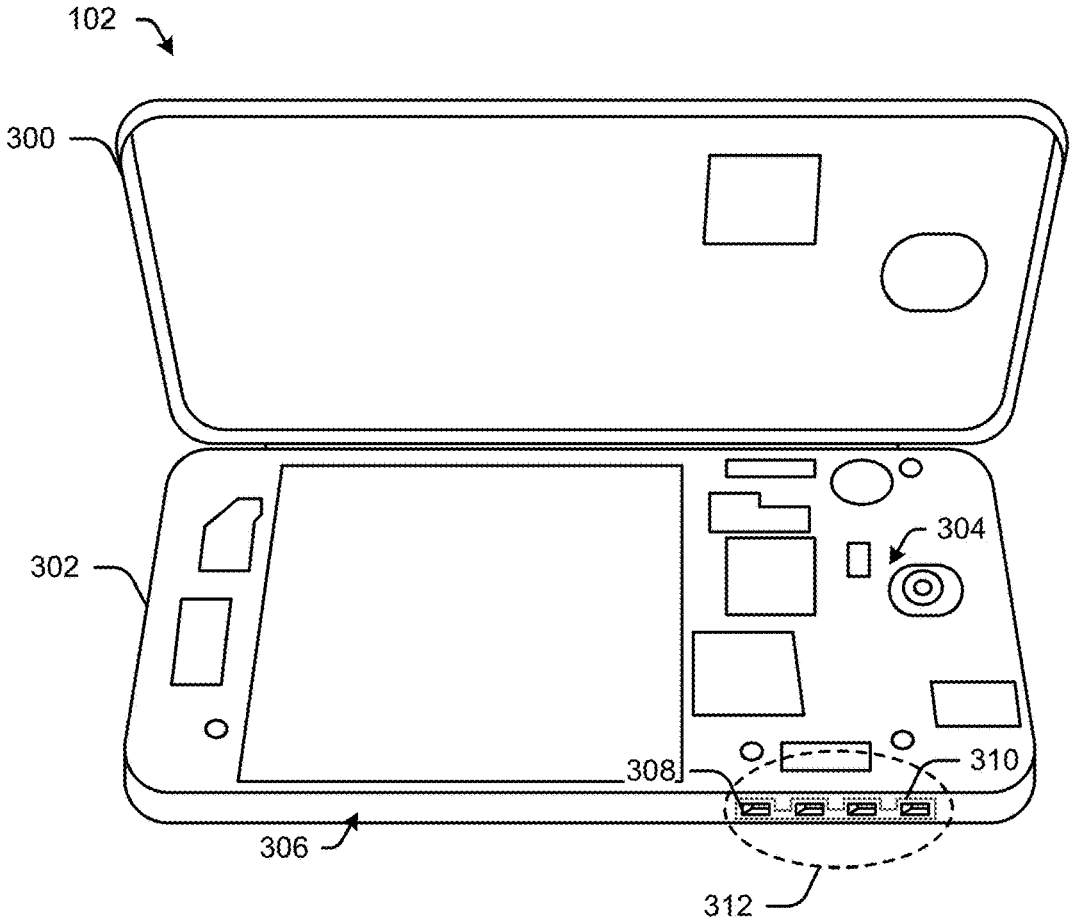
FIG. 3 illustrates an example device that includes an array of slot antenna in accordance with one or more implementations.
Figure 3:
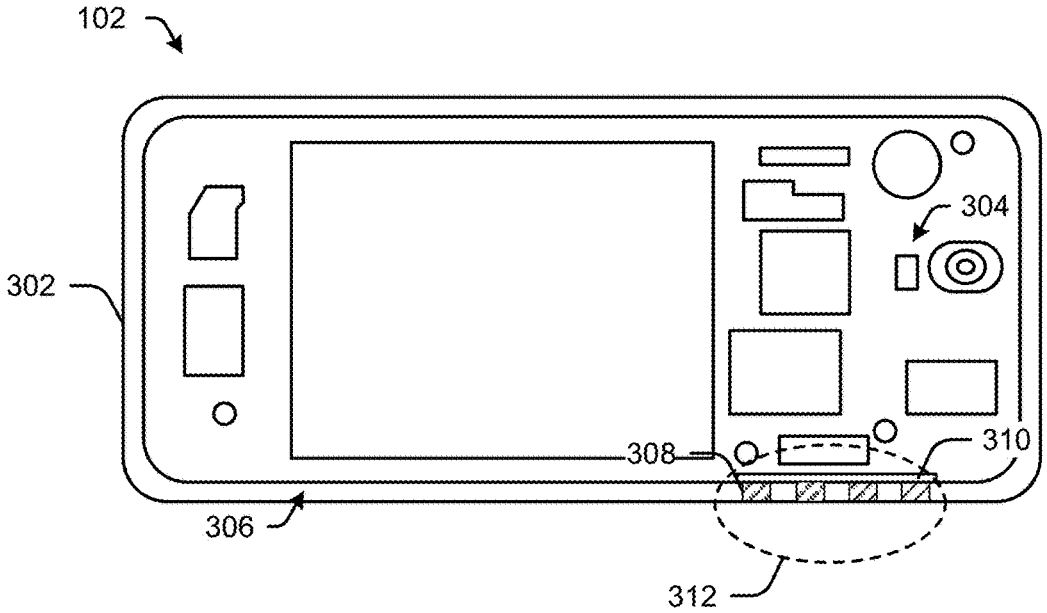

Consider now FIG. 3 that demonstrates an example of a slot antenna array in accordance with one or more implementations. In various scenarios, the example described with respect to FIG. 3 can be considered a continuation of one or more examples described with respect to FIGS. 1 and 2.

FIG. 3 includes two views of computing device 102 of FIG. 1. The upper portion of FIG. 3 illustrates a 3-dimensional (3D) view of computing device 102, where the housing structure has been generally partitioned into two sections to expose the corresponding interior: upper housing structure 300 and lower housing structure 302. The lower portion of FIG. 3 generally illustrates a topical view of lower housing structure 302 with various components included and/or associated within that structure. While FIG. 3 illustrates these partitions and groupings in a particular manner, it is to be appreciated that this is merely for discussion purposes, and that alternate or additional partitioning's and/or groupings can be utilized without departing from the scope of the claimed subject matter. The same designator values are used to identify the components in both the upper portion of FIG. 3 and the lower portion to indicate the relationship between the two viewpoints.

In various implementations, the upper housing structure and lower housing structure mechanically couple to encase and/or sheath the electronics 304 of computing device 102. The inner electronics of computing device 102 can include any suitable combination of hardware, software, and/or firmware, such as a camera, a battery, wireless link components, a display, cooling components, PCB board, processing components, radio frequency (RF) cables, Field Programmable Gate Arrays (FPGAs), Digital Signal Processing (DSP) components, and so forth. In this example, the assembly of lower housing structure 302 includes a metal band 306 around the outer edges. When upper housing structure 300 mechanically couples to lower housing structure 302, the upper housing structure externally covers electronics 304 as well as metal band 306, thus protecting the electronics and the outer edge of lower housing structure 302 from being exposed.

Metal band 306 includes a slot antenna array 308 and stripline 310, generally indicated here via region 312. As illustrated in the lower portion of FIG. 3, stripline 310 is positioned on the inner edge of metal band 306, adjacent to electronics 304, and over the various apertures associated with slot antenna array 308. Since the outer layers of the stripline form ground planes, the edge of the stripline adjacent to electronics 304 provides additional isolation between the slot antenna array and electronics 304 instead of including a setback configured to provide isolation. For example, in various implementations, the stripline introduces less than about 0.2 millimeters of depth and/or thickness to the inner edge of the metal band for resonant frequencies at 28 GHz or higher depending upon a material used for the stripline. Thus, the depth and/or thickness of the stripline can be based upon a corresponding resonant frequency and/or material. Further, since the shielding and/or isolation is provided by the stripline itself, no additional setback region needs to be included between the stripline and electronics, aside from enough space to keep the stripline from electrically shorting other circuitry to ground. For example, some implementations include a space that is less than about 0.2 millimeters between the stripline and the closed electronics adjacent to the stripline. In turn, this frees up spatial resources while maintaining a signal quality that enables successful communications. As one example, the dimension of stripline addition on the inner edge can consume [dimensions to be provided by the inventors].

While FIG. 3 illustrates a single slot antenna array/stripline pair, alternate or additional implementations include multiple slot antenna array/stripline pairs positioned multiple locations, such as a first slot antenna array/stripline pair positioned on a right side of the computing device to form a first transmission pair, a second slot antenna array/stripline pair positioned on a left side of the computing device to form a second transmission pair, a third slot antenna array/stripline pair positioned on a top side of the computing device to form a third transmission pair, and so forth. As one example, the positioning of the slot antenna array/stripline pairs can be configured to provide spherical beam coverage associated with 5G devices. As further described herein, each respective slot antenna in the array corresponds to an aperture, hole, and/or slot within metal band 306, where the metal band acts as a ground plane and the stripline includes signal feed(s) that provide independent RF feeds to each respective slot antenna.

Figure 4:
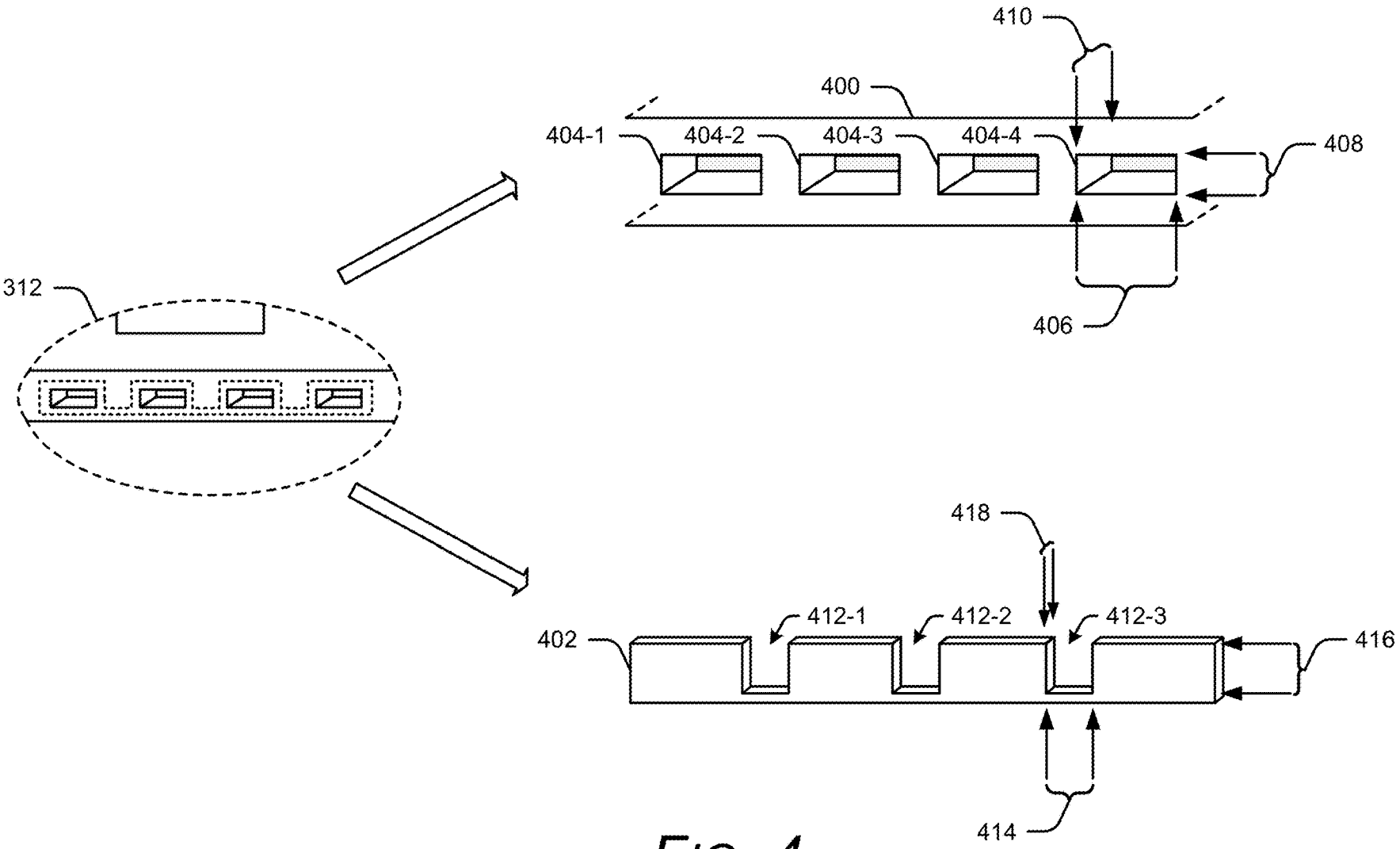
FIG. 4 illustrates example characteristics associated with a slot antenna array/stripline pair in accordance with one or more implementations.

Consider now FIG. 4 that illustrates a more detailed view of the slot antenna array/stripline pair. In various scenarios, the example described with respect to FIG. 4 can be considered a continuation of one or more examples described with respect to FIGS. 1-3.

FIG. 4 includes region 312 of FIG. 3, where the slot antenna array/stripline pair has been partitioned into two sections: slot antenna array 400 and stripline 402. Slot antenna array 400 includes four slot antenna: antenna 404-1, antenna 404-2, antenna 404-3, and antenna 404-4. While FIG. 4 includes four slot antenna, it is to be appreciated that any suitable number of slot antenna can be included in the array without departing from the scope of the claimed subject matter. Here, each respective antenna has a uniform shape relative to one another. In other words, the dimensions utilized to construct antenna 404-1 align with the dimensions utilized to construct antenna 404-2, antenna 404-3, and antenna 404-4. For example, antenna 404-4 is illustrated here as having a rectangular shape that corresponds to a width 406, a height 408, and a depth 410, each of which represents an arbitrary value selected to create a desired resonant frequency of antenna 404-4. In some implementations, the values of the width, height, and/or depth is based off of a half-waveguide wavelength. One or more implementation utilize a width size that falls within a range of 3.5 millimeter (mm) to 5.5 mm, a height size that falls within a range of 0.4 mm to 0.8 mm, and a depth that falls within a range of 1 mm to 4 mm. In this example, each of antenna 404-1, antenna 404-2, and antenna 404-3 shared the same shape and dimensions as antenna 404-4. Alternate or additional implementations construct each respective antenna with different shapes and/or dimensions from one another and/or a combination of uniform and differing antenna. For example, each antenna can be designed with dimensions that cause each respective antenna to resonate at a different frequency such that the grouping of antenna collectively span over multiple bands of frequencies. Alternately or additionally, cross-slot antenna can be utilized to provide dual-polarized components by selecting stripline(s) feed structures with a corresponding flexibility to feed each slot of the cross-slot antenna independently. For instance, in some implementations, each slot antenna can have dimensions corresponding to half-waveguide wavelength.

While FIG. 4 illustrates each slot antenna as being void of structure, alternate or additional implementations add supporting material within the aperture that does not disrupt the signal propagation. For instance, each slot antenna can include various types of dielectric (e.g., ceramics, paper, glass, plastic, etc.) as a supporting material to the overall housing structure. Various implementations select the dielectric based upon the desired resonant frequency of the corresponding slot antenna.

Stripline 402 provides independent RF feeds to each respective antenna, as well as isolation between the feeds. As one skilled in the art will appreciate, stripline 402 generally represents a circuit that forms a transmission line, such as through the use of parallel ground planes, an insulating material, and a flat metal strip positioned between the ground planes and surrounded by the insulating material. In various implementations, stripline 402 includes multiple notches and/or apertures, identified here as notch 412-1, notch 412-2, and notch 412-3, where each notch represents an absence of structure in the stripline. To further explain, stripline 402 has a general rectangular shape, with the exception of notches 412-1 through 412-3. Here, using the context of a generally rectangular shape, each notch in stripline 402 represents a cutout that creates an absence of structure and/or absence of substance in the stripline. In turn, this provides additional isolation between the independent feeds by disrupting any unintended wave guides and/or signals and improving the resultant transmission signal generated by the slot antenna array. Alternate or additional implementations use a group of vias closely spaced in a line perpendicular to the line connecting the slots.

In this example, each notch has a uniform shape relative to one another. For example, notch 412-3 has a rectangular shape with a width 414, a height 416, and a depth 418 that represent arbitrary lengths. Accordingly, since each notch has uniform dimensions and shapes relative to one another, notch 412-1 and notch 412-2 are also rectangular in shape with the same width, height, and depth as those illustrated for notch 412-3. By way of example and not of limitation, one or more implementations utilize a notch that has a width with a size that falls within a range of 0.4 mm 0.8 mm, a height with a size that falls within a range of 2.5 mm to 4.5 mm, and a depth with a size that falls within a range of 0.1 mm to 0.3 mm. Alternate or additional implementations construct the respective notches using different shapes and/or dimensions from one another and/or a combination of uniform and differing notches without departing from the scope of the claimed subject matter. As further described herein, the addition of these notches helps perturb unintentional wave propagation in the waveguide created between the two conductors of the stripline that consequently couples RF feeds, thus providing additional isolation. This allows for the multiple slot antenna to form an array with less degradation and/or interference in the resultant transmission signal without additional setbacks and/or clearance, thus freeing up spatial resources relative to other implementations. In some implementations, each notch has dimensions corresponding to 0.8 mm of the stripline flex width (e.g., depth 418).

Figure 5:
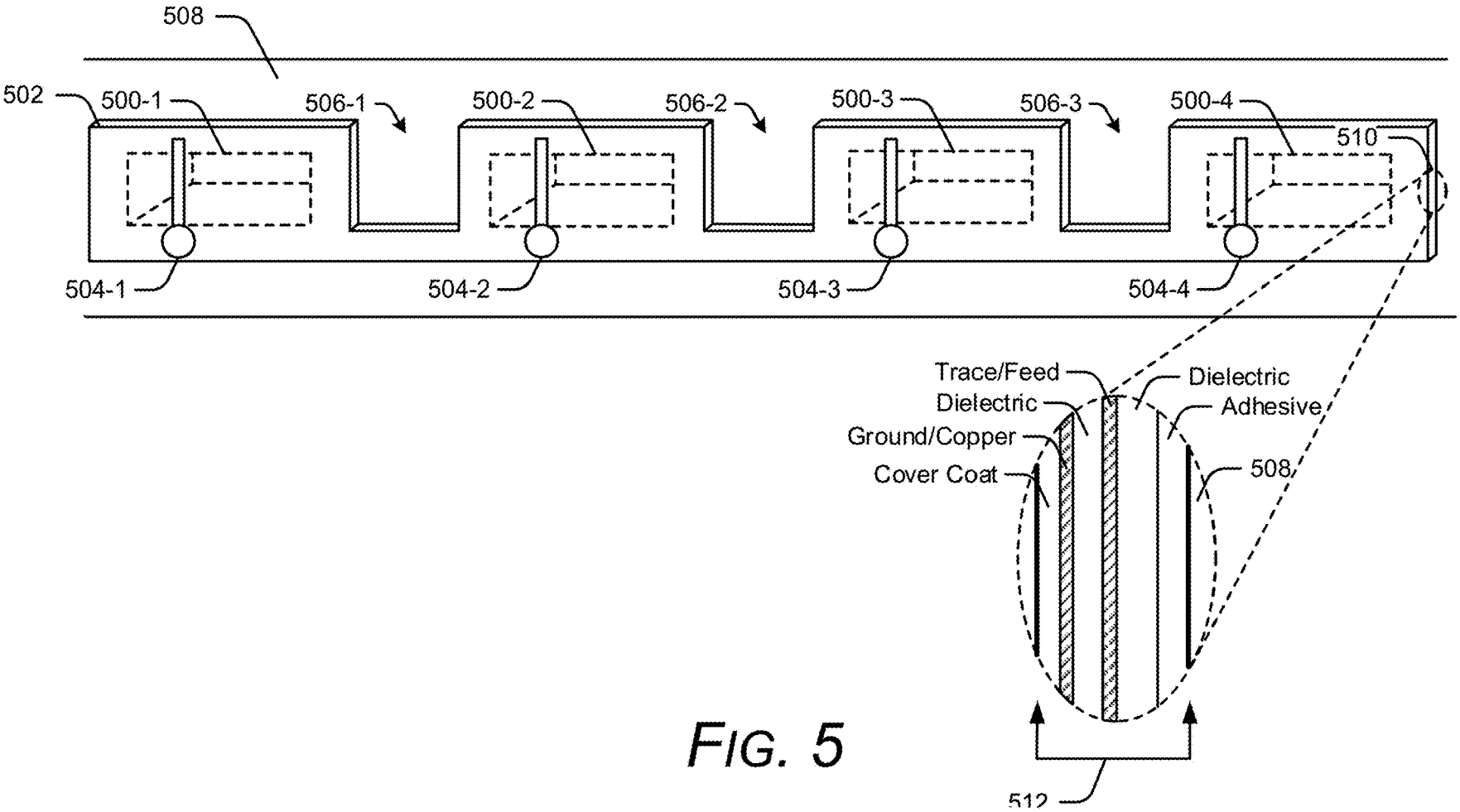
FIG. 5 illustrates an example slot antenna array/stripline pair in accordance with one or more implementations.

Now consider now FIG. 5 that illustrates an example slot antenna array/stripline pair with additional detail that is in accordance with one or more implementations. In various scenarios, the example described with respect to FIG. 5 can be considered a continuation of one or more examples described with respect to FIGS. 1-4.

FIG. 5 includes an array of slot antenna, where each respective slot antenna of the array is labeled here as slot antenna 500-1, slot antenna 500-2, slot antenna 500-3, and slot antenna 500-4. FIG. 5 also includes stripline 502, where portions of the stripline that include structure overlay on top of each respective antenna. These portions each include a respective RF feed that is used as a signal source which excites the respective slot antenna to generate transmission signals. For example, RF feed 504-1 represents a first signal feed that originates from electronic circuitry, such as internal electronics 304 of FIG. 3, and connects and/or couples to slot antenna 500-1. Similarly, RF feed 504-2 represents a second signal feed that couples to slot antenna 500-2, RF feed 504-3 corresponds to a third signal feed that couples to slot antenna 500-3, and RF feed 504-4 corresponds to a fourth signal feed that couples to slot antenna 500-4. Each of these feeds electronically and/or capacitively couples to various types of hardware, software, and/or firmware to generate wireless signals. In various implementations, these feeds electronically and/or capacitively couple to electronics 304 of FIG. 3 and/or wireless link components 110 of FIG. 1. In various implementations, multiband functionality can be achieved using off-center stripline feed(s) and radiating slots with particular widths that have a double-resonant behavior when fed off-center.

FIG. 5 also illustrates various notches that provide isolation between the signal feeds. For example, notch 506-1 provides isolation between RF feed 504-1 and RF feed 504-2, notch 506-2 provides isolation between RF feed 504-2 and RF feed 504-3, and notch 506-3 provides isolation between RF feed 504-3 and RF feed 504-4. In turn, this isolation improve the beamforming capabilities of the slot antennas when arranged in an array as further described herein. As further described herein, the size and/or dimensions of each respective notch can be selected in any suitable manner. In at least one embodiment, the depth of the notch has a length that corresponds to 70-80% of the width of the notch.

In FIG. 5, stripline 502 attaches and/or adheres to metal band 508, where the metal band corresponds to an outer edge of a housing structure. For discussion purposes, the side edge of stripline 502 has been magnified in image 510 to demonstrate example layers included in the stripline. Collectively, these layers give the stripline an arbitrary width 512 that corresponds to a thickness associated with the stripline. For example, some implementations of stripline 502 have a width that is generally included in a range corresponding to 65 micrometers (μm) to 195 μm. In FIG. 5, stripline 502 includes (from left to right) a cover coat layer, a ground layer, a first dielectric layer, a feed layer, a second dielectric layer, and an adhesive layer, where the cover coat layer is the outmost layer away from metal band 508 and the adhesive layer is the layer adjacent to metal band 508. Some implementations use a same material for the first dielectric layer and the second dielectric layer, while alternate or additional implementations utilize different materials. In various implementations, the feed layer corresponds to an RF signal feed that is used to excite the slot antenna as further described herein. Collectively, these layers contribute to width 512.

Figure 6:
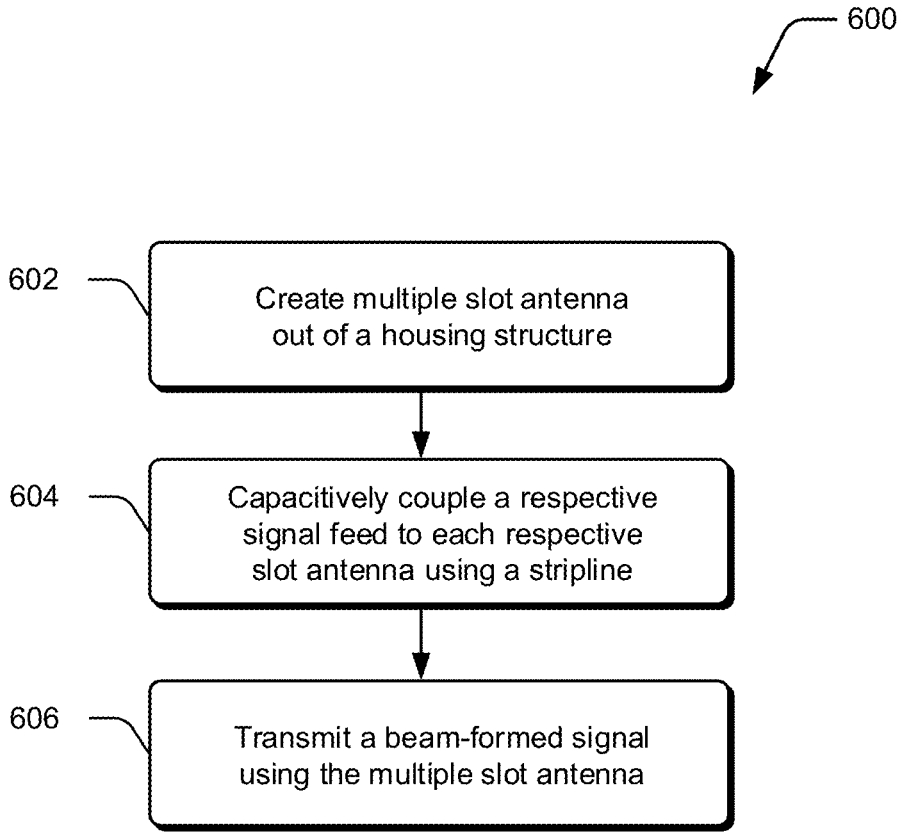
FIG. 6 illustrates a flow diagram of transmitting signals using a slot antenna array/stripline pair in accordance with one or more implementations.

Now consider FIG. 6 that illustrates a method 600 of transmitting a beam-formed wireless signal using a slot antenna array/stripline pair in accordance with one or more implementations. The method can be performed by any suitable combination of hardware, software, and/or firmware. In at least some implementations, aspects of the method can be implemented by one or more suitably configured hardware components and/or software modules, such as those described with respect to computing device 102 of FIG. 1. While the method described in FIG. 6 illustrates these steps in a particular order, it is to be appreciated that any specific order or hierarchy of the steps described here is used to illustrate an example of a sample approach. Other approaches may be used that rearrange the ordering of these steps. Thus, the order steps described here may be rearranged, and the illustrated ordering of these steps is not intended to be limiting.

Various implementations create multiple slot antenna out of a housing structure at 602. As one example, some implementations create apertures and/or slots out of a metal band that surrounds a chassis of a computing device. Each respective slot antenna can have the same dimensions as the other slot antenna and/or each slot antenna can have differing dimensions from one another. As one example, the dimensions of the respective slot antennas can correspond to half resonant frequencies associated with transmitting and/or receiving waveforms associated with a millimeter-wave communication system as further described herein. Various implementations form a single slot antenna array using the multiple slot antenna, while alternate or additional implementations form multiple slot antenna array. To illustrate, a mobile phone with a generally rectangular shape can have a first array of slot antenna positioned on a first edge of the rectangle, a second array of slot antenna positioned on a second edge of the rectangle, a third array of slot antenna positioned on a third edge of the rectangle, and so forth. A slot antenna array can included any suitable number of respective slot antenna, where some implementations based the number of slot antenna on a desired beam-form signal as further described herein.

At 604, one or more implementations electronically and/or capacitively couple a respective signal feed to each respective slot antenna of the multiple antenna using a stripline. For instance, referring back to the scenario in which the slot antenna are created from a metal band of a chassis, some implementations overlay the stripline on an inner edge of the metal band and electronically and/or capacitively couple each respective slot antenna to a respective RF feed. Various implementations overlay a stripline that includes notches and/or an absence of structure within the stripline to provide isolation between the respective RF feeds. In some scenarios, the notches within the stripline are physically located on the stripline to be positioned in-between each slot antenna when the stripline is electronically and/or capacitively coupled to the slot antenna.

In response to electronically and/or capacitively coupling the signal feeds to the slot antennas, one or more implementations transmit a beam-formed signal using the multiple slot antennas at 606. This can include independently modifying each respective RF feed such that the slot antenna array operates as a phased array antenna. Various implementations beamform high frequency signals, such as millimeter-waves associated with 5G communication systems.

By creating slot antenna out of an existing housing structure, as well as a stripline that includes independent signal feeds, various implementations generate antenna arrays for high frequency waveforms using less spatial resources of a computing device relative to other implementations. A stripline positioned on an inner edge of a metal band inherently provides isolation due to one of the corresponding ground planes of the stripline being placed adjacent to the electronics. In turn, this reduces and/or eliminates the need to include a setback or clearance between the feeds and the electronics that is configured to provide additional isolation. Further, slot antenna created through apertures in a metal band utilize an existing housing structure for antenna generation, rather than incorporation additional components that consume spatial resources.

Having described an example of slot antenna array/stripline pairs, consider now a discussion of example devices in which can be used for various implementations.

Example Device

Figure 7:
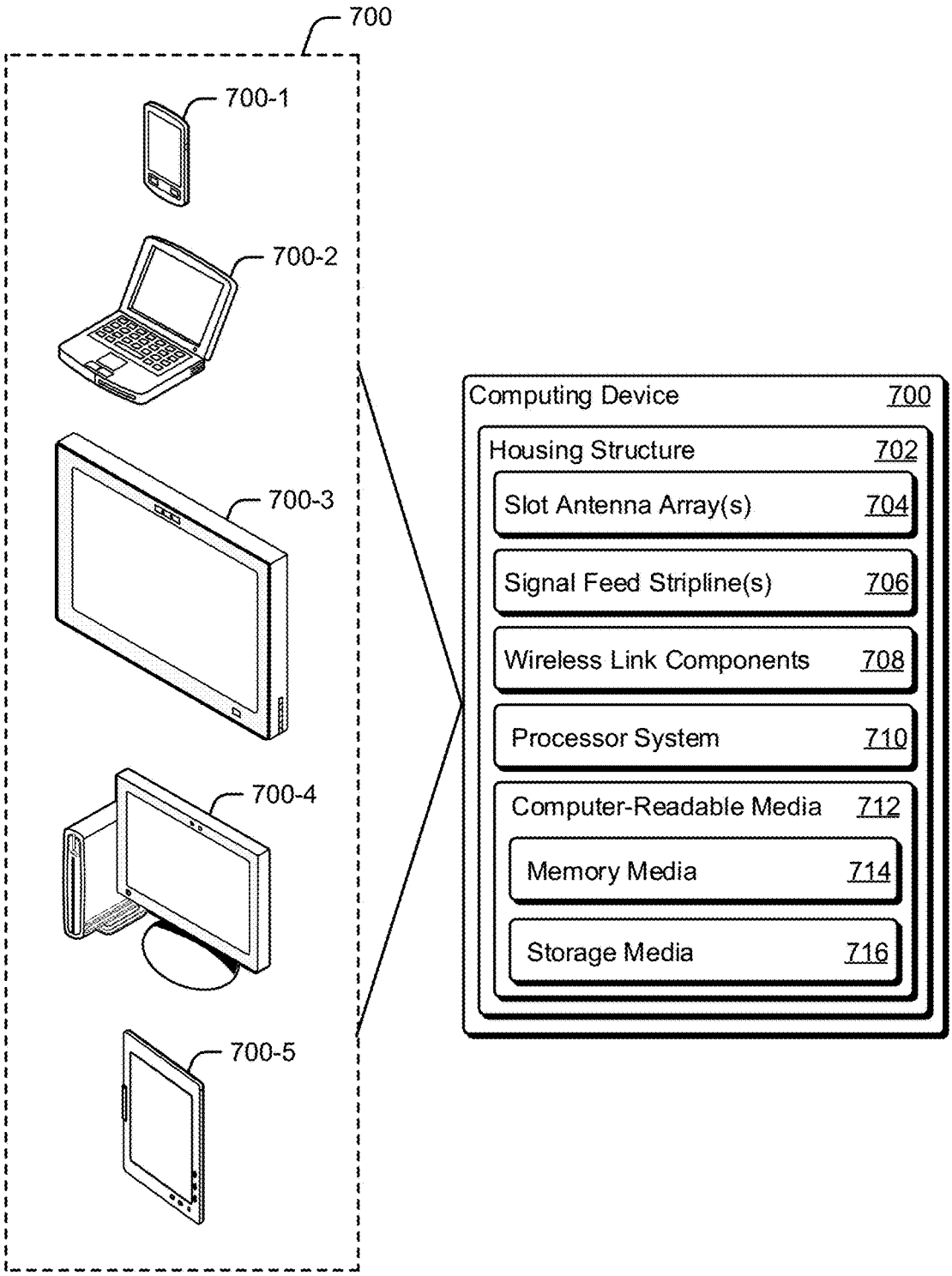
FIG. 7 is an illustration of an example device that can be used to employ slot antenna arrays in accordance with one or more implementations.

FIG. 7 illustrates various components of an example computing device 700 that represents any suitable type of computing device that can be used to implement various aspects of slot antenna arrays as further described herein. Accordingly, FIG. 7 includes various non-limiting example devices including: mobile phone 700-1, laptop 700-2, smart television 700-3, monitor 700-4, and tablet 700-5. In various scenarios, the example described with respect to FIG. 7 can be considered a continuation of one or more examples described with respect to FIGS. 1-6.

Computing device 700 includes housing structure 702 that generally represents a physical structure used to house various electronic components, batteries, shielding, PCBs, and so forth, associated with computing device 700. Housing structure 702 can have any physical shape, size, components, partitions, etc. In various implementations, housing structure 702 includes a metal band around an outer edge that acts as a ground plane.

Housing structure includes and suitable number of slot antenna arrays 704 and striplines 706, where each respective slot antenna array has a respective stripline that forms a respective transmission pair as further described herein. In some implementations, the slot antenna arrays 704 comprise apertures and/or slots that remove structure from the metal band that surround the outer edge of housing structure 702. In turn, striplines 706 supply each respective slot antenna with a respective RF feed such that the slot antennas collectively function as an antenna array that transmits beam-formed wireless signals. Various implementations position each respective stripline on an inner edge of the metal band such that the stripline provides a shielding and/or isolation between the slot antenna array and various electronic components internal to housing structure 702 using one of the corresponding ground planes of the stripline.

Alternately or additionally, each stripline includes one or more apertures and/or notches in between each respective RF feed to provide additional isolation.

Housing structure 702 also includes wireless link components 708, which are used here to generally represent hardware, software, firmware, or any combination thereof, that is used to establish, maintain, and communicate over a wireless link. Wireless link component(s) 708 work in conjunction with slot antenna arrays 704 and/or striplines 706 to send, receive, encode, and decode corresponding messages communicated via the wireless signals, and can be enclosed partially or fully within housing structure 702. The wireless link components can be multipurpose (e.g., support multiple different types of wireless links) or can be single purpose. Computing device 700 can include multiple types of wireless link components to support multiple wireless communication paths, or simply include a set of wireless link components configured for a single wireless communication path.

Housing structure 702 includes processor system 710 that represents any of application processors, microprocessors, digital-signal processors, controllers, and the like, that processes computer-executable instructions to control operation of the computing device. A processing system may be implemented at least partially in hardware, which can include components of an integrated circuit or on-chip system, digital-signal processor, application-specific integrated circuit, field-programmable gate array, a complex programmable logic device, and other implementations in silicon and other hardware. Alternatively, or in addition, the electronic device can be implemented with any one or combination of software, hardware, firmware, or fixed-logic circuitry that is implemented in connection with processing and control circuits. Although not shown, computing device 700 can include a system bus, crossbar, interlink, or data-transfer system that couples the various components within the device. A system bus can include any one or combination of different bus structures, such as a memory bus or memory controller, data protocol/format converter, a peripheral bus, a universal serial bus, a processor bus, or local bus that utilizes any of a variety of bus architectures.

Housing structure 702 also includes computer-readable media 712, which includes memory media 714 and storage media 716. Applications and/or an operating system (not shown) embodied as computer-readable instructions on computer-readable media 712 are executable by processor system 710 to provide some, or all, of the functionalities described herein. For example, various embodiments can access an operating system module that provides high-level access to underlying hardware functionality by obscuring implementation details from a calling program, such as protocol messaging, display device configuration, register configuration, memory access, and so forth. Various implementations of computer-readable media include one or more memory devices that enable data storage, examples of which include random access memory (RAM), non-volatile memory (e.g., read-only memory (ROM), flash memory, EPROM, EEPROM, etc.), and a disk storage device. Thus, computer-readable media 712 can be implemented at least in part as a physical device that stores information (e.g., digital or analog values) in storage media, which does not include propagating signals or waveforms. Various implementations can use any suitable types of media such as electronic, magnetic, optic, mechanical, quantum, atomic, and so on.

In view of the many possible aspects to which the principles of the present discussion may be applied, it should be recognized that the implementations described herein with respect to the drawing figures are meant to be illustrative only and should not be taken as limiting the scope of the claims. Therefore, the techniques as described herein contemplate all such implementations as may come within the scope of the following claims and equivalents thereof.

We claim:

1. A computing device comprising:

a housing structure configured to house hardware components of the computing device, the housing structure comprising a metal band that forms an outer edge of the housing structure;

at least one wireless link component included at least partially within the housing structure and configured to maintain at least one wireless link associated with a millimeter-wave communication system between the computing device and another device;

a plurality of slot antennas included in the metal band that collectively form a slot antenna array; and a stripline positioned on an inner edge of the metal band that electronically couples the at least one wireless link component to the plurality of slot antennas, the stripline positioned to provide shielding between the slot antenna array and one or more of the hardware components, the stripline comprising:

a ground plane positioned adjacent to the one or more hardware components and between the inner edge of the metal band and the one or more hardware components;

a plurality of radio frequency (RF) signal feeds associated with the at least one wireless link component, each respective RF signal feed configured to excite a respective slot antenna of the plurality of slot antennas; and a plurality of notches, each respective notch configured to isolate the plurality of RF signal feeds from unintended signals.

2. The computing device of claim 1, wherein the slot antenna array is configured to be operable over one or more frequencies that span 24 Gigahertz (GHz) to 86 GHz.

3. The computing device of claim 1, wherein the computing device comprises a mobile phone.

4. The computing device of claim 1, wherein the millimeter-wave communication system comprises a $5^{th}$ Generation (5G) wireless communication system.

5. The computing device of claim 1, wherein each respective slot antenna of the plurality of slot antennas comprises a dielectric supporting material.

6. The computing device of claim 1, wherein the stripline adds less than 0.2 millimeter thickness to the inner edge of the metal band.

7. The computing device of claim 1, wherein at least one slot antenna of the plurality of slot antennas has a generally rectangular shape based off of a half-waveguide wavelength, wherein a width of the rectangular shape has a size included in a range comprising 3.5 millimeters (mm) to 5.5 mm, a height of the rectangular shape has a size included a range comprising 0.4 mm to 0.8 mm, and a depth of the rectangular shape has a size included in a range comprising 1 mm to 4 mm.

8. The computing device of claim 1, wherein the plurality of slot antennas and the stripline form a first transmission pair that is positioned on a first side of the computing device; and wherein the computing device comprises a second plurality of slot antennas and a second stripline that form a second transmission pair that is positioned on a second side of the computing device.

9. The computing device of claim 1, wherein the plurality of slot antennas comprises at least four slot antennas.

10. The computing device of claim 9, wherein the plurality of notches comprises at least three notches, each notch being positioned between a respective pair of slot antennas of the at least four slot antennas.

11. A mobile phone comprising:

a housing structure configured to house hardware components of the mobile phone, the housing structure comprising a metal band that forms an outer edge of the housing structure;

at least one wireless link component included at least partially within the housing structure and configured to maintain at least one wireless link associated with a millimeter-wave communication system between the mobile phone and another device;

a plurality of slot antennas included in the metal band that collectively form a slot antenna array; and a stripline positioned on an inner edge of the metal band that electronically couples the at least one wireless link component to the plurality of slot antennas, the stripline positioned to provide shielding between the slot antenna array and one or more of the hardware components, the stripline comprising:

a ground plane positioned adjacent to the one or more hardware components and between the inner edge of the metal band and the one or more hardware components;

a plurality of radio frequency (RF) signal feeds associated with the at least one wireless link component, each respective RF signal feed configured to excite a respective slot antenna of the plurality of slot antennas; and a plurality of notches, each respective notch configured to isolate the plurality of RF signal feeds from unintended signals.

12. The mobile phone of claim 11, wherein the slot antenna array is configured to be operable over one or more frequencies that span 24 Gigahertz (GHz) to 86 GHz.

13. The mobile phone of claim 11, wherein the millimeter-wave communication system comprises a $5^{th}$ Generation (5G) wireless communication system.

14. The mobile phone of claim 11, wherein each respective slot antenna of the plurality of slot antennas comprises a dielectric supporting material.

15. The mobile phone of claim 11, wherein the stripline adds less than 0.2 millimeter thickness to the inner edge of the metal band.

16. The mobile phone of claim 11, wherein at least one slot antenna of the plurality of slot antennas has a generally rectangular shape based off of a half-waveguide wavelength, wherein a width of the rectangular shape has a size included in a range comprising 3.5 millimeters (mm) to 5.5 mm, a height of the rectangular shape has a size included a range comprising 0.4 mm to 0.8 mm, and a depth of the rectangular shape has a size included in a range comprising 1 mm to 4 mm.

17. The mobile phone of claim 11, wherein the plurality of slot antennas and the stripline form a first transmission pair that is positioned on a first side of the mobile phone; and wherein the mobile phone comprises a second plurality of slot antennas and a second stripline that form a second transmission pair that is positioned on a second side of the mobile phone.

18. The mobile phone of claim 11, wherein the plurality of slot antennas comprises at least four slot antennas.

19. The mobile phone of claim 18, wherein the plurality of notches comprises at least three notches, each notch being positioned between a respective pair of slot antennas of the at least four slot antennas.

* * * * *